US006949014B2

(12) United States Patent
Barrier et al.

(10) Patent No.: US 6,949,014 B2
(45) Date of Patent: Sep. 27, 2005

(54) CONTROL CAGE FOR ABRASIVE BLAST WHEEL

(75) Inventors: Ronald G. Barrier, Newnan, GA (US); Mathew L. Loutzenheiser, LaGrange, GA (US); Pierre L. Tanguay, Newnan, GA (US)

(73) Assignee: Wheelabrator Group, Inc., Golden, CO (US)

( * ) Notice: Subject to any disclaimer, the term of this patent is extended or adjusted under 35 U.S.C. 154(b) by 0 days.

(21) Appl. No.: 10/715,801

(22) Filed: Nov. 17, 2003

(65) Prior Publication Data

US 2005/0107014 A1 May 19, 2005

(51) Int. Cl.[7] ..... B24C 5/06
(52) U.S. Cl. ..... 451/95; 451/97
(58) Field of Search ..... 451/95, 96, 97, 451/98, 99

(56) References Cited

U.S. PATENT DOCUMENTS

| | | | | |
|---|---|---|---|---|
| 1,462,786 | A | | 7/1923 | Cleveland |
| 2,049,466 | A | | 8/1936 | Minich |
| 2,077,635 | A | | 4/1937 | Minich |
| 2,077,638 | A | | 4/1937 | Minich |
| RE20,538 | E | | 10/1937 | Minich |
| 2,108,211 | A | | 2/1938 | Rosenberger et al. |
| 2,135,510 | A | | 11/1938 | Hollingsworth |
| 2,204,618 | A | | 6/1940 | Peik |
| 2,301,508 | A | | 11/1942 | Blount |
| 2,352,588 | A | | 6/1944 | Rosenberger et al. |
| 2,359,313 | A | | 10/1944 | Keefer |
| 2,493,215 | A | | 1/1950 | Barnes |
| 2,590,576 | A | | 3/1952 | Rosenberger et al. |
| 2,708,814 | A | | 5/1955 | Straub |
| 3,368,308 | A | | 2/1968 | Physioc, III |
| 3,436,867 | A | | 4/1969 | Fuerst |
| 3,653,239 | A | | 4/1972 | Carpenter, Jr. |
| 3,678,629 | A | | 7/1972 | Leliaert |
| 3,683,556 | A | * | 8/1972 | Leliaert ..... 451/97 |
| 3,694,963 | A | | 10/1972 | Leliaert |
| 3,785,105 | A | | 1/1974 | Freeman |

(Continued)

FOREIGN PATENT DOCUMENTS

| | | |
|---|---|---|
| EP | 1419854 A1 | 5/2004 |
| GB | 533051 | 2/1941 |

*Primary Examiner*—Dung Van Nguyen
(74) *Attorney, Agent, or Firm*—Lowrie, Lando & Anastasi, LLP

(57) ABSTRACT

A control cage for an abrasive blasting wheel includes a housing forming an interior chamber, a blast media outlet positioned in the housing, and a channel formed in an inner side of the housing. A distribution device for an abrasive blasting wheel includes an impeller having a media inlet at one end adapted to receive blast media and a plurality of impeller media outlets constructed and arranged to allow egress of the blast media upon rotation of the impeller, a control cage surrounding the impeller and having a cage media outlet adapted for passage of the blast media, and a channel formed between the impeller and the control cage. The channel of the distribution device may be formed on an inner side of the control cage, an outer side of the impeller, or both.

27 Claims, 7 Drawing Sheets

U.S. PATENT DOCUMENTS 3,936,979 A 2/1976 Fuerst
4,207,712 A 6/1980 Toedtli
4,244,150 A 1/1981 Goff
4,249,350 A 2/1981 Goff
4,329,819 A 5/1982 May
4,333,278 A 6/1982 Schulte et al.
4,336,672 A 6/1982 Kwolek
4,447,993 A 5/1984 Laido
4,480,413 A 11/1984 Schulte et al.
4,509,300 A 4/1985 Carpenter et al.
4,565,035 A 1/1986 Carpenter, Jr. et al.
4,723,379 A * 2/1988 Macmillan et al. ..... 451/97
4,751,798 A 6/1988 McDade
4,941,296 A 7/1990 Carpenter
4,941,297 A 7/1990 Carpenter
5,024,028 A 6/1991 Pierce et al.
5,081,801 A 1/1992 Fylak
5,209,024 A 5/1993 Carpenter et al.
5,688,162 A 11/1997 Williams
5,759,091 A 6/1998 MacMillan
5,769,693 A 6/1998 Wadephul
5,779,524 A 7/1998 Swain
5,846,124 A 12/1998 Rokutanda et al.
5,888,125 A 3/1999 Kuehn
6,126,516 A 10/2000 Barrier et al.

* cited by examiner

CONTROL CAGE FOR ABRASIVE BLAST WHEEL

BACKGROUND OF INVENTION

1. Field of Invention

The present invention is related to abrasive blast wheels used for cleaning or treating surfaces of various objects and, more specifically, to control cages used in such abrasive blast wheels.

2. Discussion of Related Art

A typical abrasive blast wheel is disclosed in U.S. Pat. No. 4,333,278 (the "'278 patent"). The '278 patent teaches a bladed centrifugal blasting wheel formed by a pair of spaced wheel plates with blades inserted into radial grooves. Blast media is fed from a feed spout into a rotating impeller situated within a control cage at the center of the blast wheel. The media is fed from the impeller, though an opening in a control cage, and onto the heel or inner ends of the rotating blades. The media travels along the faces of the blades and is thrown from the tips of the blades at the surface to be treated.

SUMMARY OF INVENTION

According to one embodiment of the invention, a control cage for an abrasive blasting wheel includes a housing forming an interior chamber, a blast media outlet positioned in the housing, and a channel formed in an inner side of the housing.

According to another embodiment of the invention, a distribution device for an abrasive blasting wheel includes an impeller having a media inlet at one end adapted to receive blast media and a plurality of impeller media outlets constructed and arranged to allow egress of the blast media upon rotation of the impeller, a control cage surrounding the impeller and having a cage media outlet adapted for passage of the blast media, and a channel formed between the impeller and the control cage. In various embodiments, the channel may be formed on an inner side of the control cage, an outer side of the impeller, or both.

According to another embodiment of the invention, an abrasive blast wheel assembly includes a rotor having a face and an axis generally perpendicular to the face, a plurality of vanes extending from the face of the rotor, each vane having a heel end towards the axis of the rotor and a discharge end opposite the heel end, an impeller positioned about the axis of the rotor, the impeller having a media inlet at one end adapted to receive blast media and a plurality of impeller media outlets constructed and arranged to allow egress of blast media upon rotation of the impeller, a control cage surrounding the impeller and having a cage media outlet adapted for passage of blast media to the heel ends of the vanes; and a channel formed between the impeller and the control cage. In various embodiments, the channel may be formed on an inner side of the control cage, an outer side of the impeller, or both.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
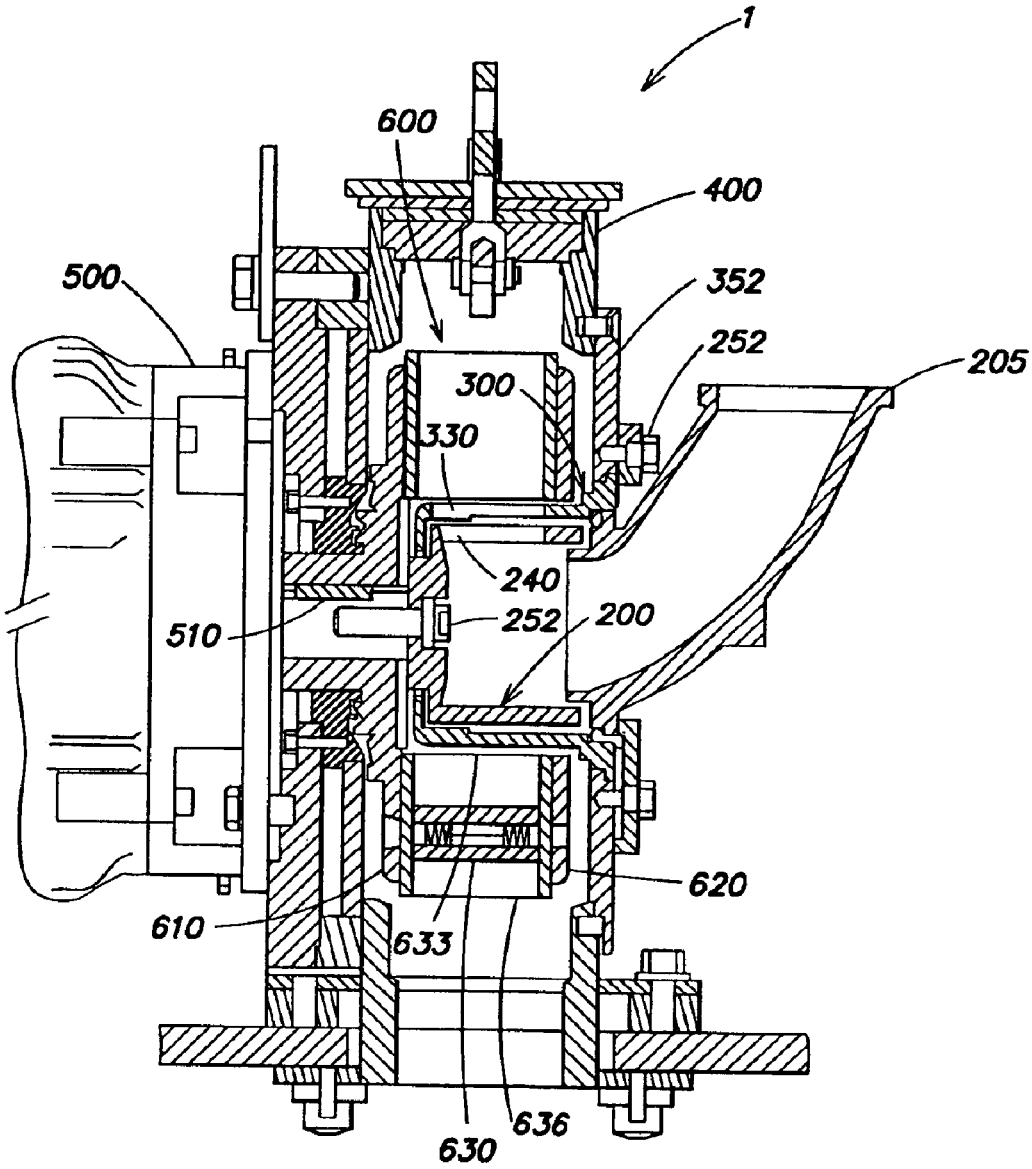
FIG. 1 is a side sectional view of a blast wheel assembly having a control cage according to the teachings of the present invention.

This invention is not limited in its application to the details of construction and the arrangement of components set forth in the following description or illustrated in the drawings. The invention is capable of other embodiments and of being practiced or carried out in various ways. Also, the phraseology and terminology used herein is for the purpose of description and should not be regarded as limiting. The use of "including," "comprising," "having," "containing," "involving," and variations thereof is meant to encompass the items listed and equivalents, as well as additional items.

The present invention is directed to a control cage for an abrasive blast wheel. In one embodiment, the control cage of the present invention includes a cylindrical wall forming a housing having an interior chamber and a media opening for allowing the egress of blast media from the interior chamber. A channel is provided to direct the blast media through the media opening. In some embodiments, the channel may be formed on the inner surface of the housing, for example by a step or a ridge formed on that surface. In other embodiments, the channel may be formed on an impeller within the housing, such as by a step or ridge formed on the outer surface of the impeller. In still other embodiments, the channel may be formed on both the control cage and the impeller. These and other specific embodiments of the invention will now be described with reference to the Figures.

FIG. 1 illustrates a typical blast wheel assembly in which the control cage of the present invention may be employed. In FIG. 1, control cage 300 is part of a blast wheel assembly 1 used to treat a surface (not shown) by projecting blast media (not shown) at the surface. The treatment may be in the nature of cleaning, peening, abrading, eroding, deburring, deflashing, and the like, and the blast media typically consists of solid particles such as shot, grit, segments of wire, sodium bicarbonate, or other abrasives, depending on the surface being treated and/or the material being removed from the surface.

Figure 2:
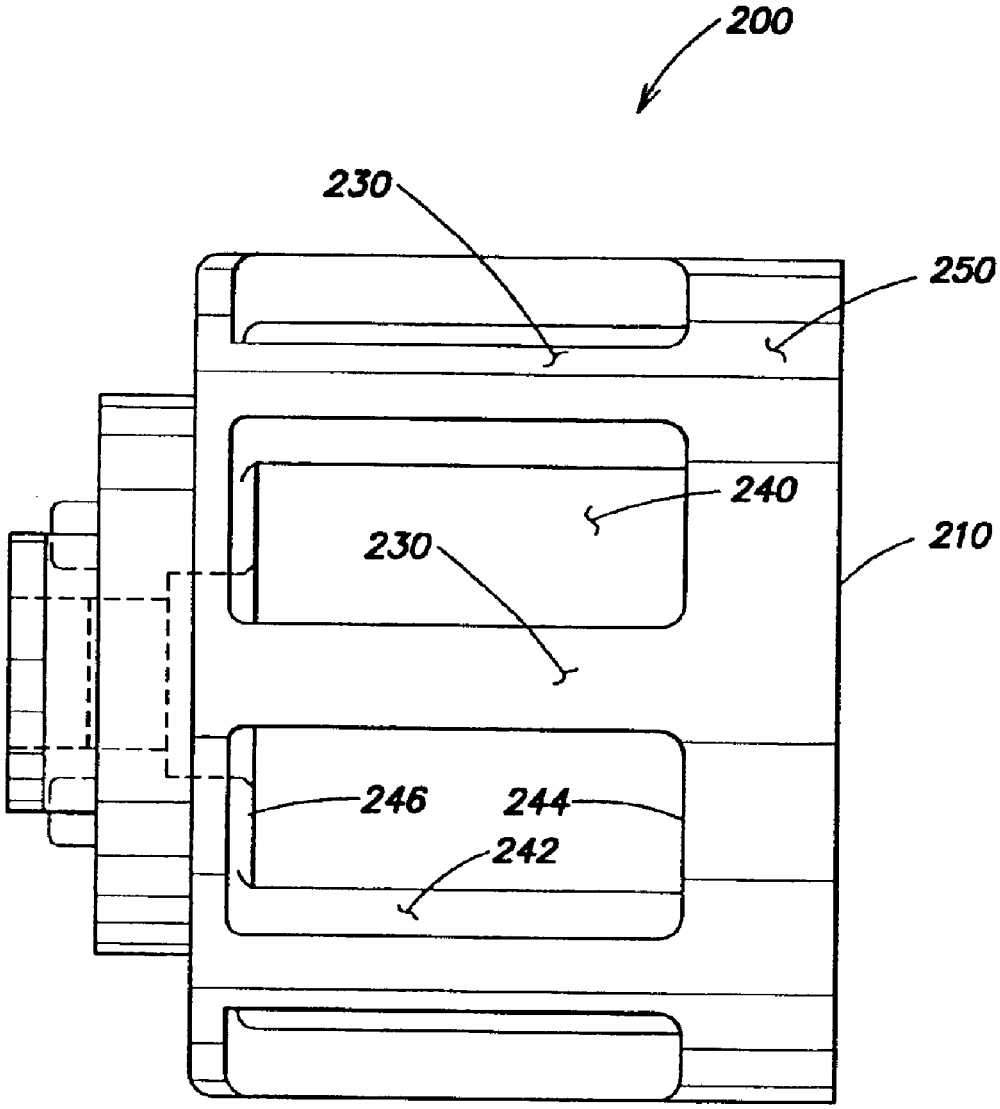
FIG. 2 is a side view of one embodiment of an impeller suitable for use with the blast wheel assembly of FIG. 1.

As can be seen in FIGS. 1 and 2, the impeller 200 of this embodiment is approximately cylindrical in shape and includes a media opening 210 at one end adapted to receive blast media from a feed spout 205. The other end of impeller 200 of the illustrated embodiment is connected to a rear wheel 610, which in turn is connected to motor 500, in this embodiment by a cap screw 252. In other embodiments of the invention, the impeller 200 may have other shapes, and may, for example, have interior or exterior walls that taper in either direction along its axis. The size and thickness of the impeller will vary depending on the size of the blast wheel assembly and the desired performance characteristics.

Typically, the impeller will be made of a ferrous material, such as cast or machined iron or steel, although other materials may also be appropriate. In one particular embodiment, the impeller is formed of cast white iron.

Seen most clearly in FIG. 2, a plurality of impeller vanes 230 are present in the side wall 250 of the impeller and define of plurality of impeller openings 240. The impeller openings 240 are constructed to allow blast media to move out through the side wall 250 of the impeller upon rotation of the impeller 200, as described more fully below. In the illustrated embodiment, the impeller openings 240 are eight in number, are approximately rectangular in shape, and extend approximately 4/5 of the length of the impeller 200. In other embodiments, however, there may be more or fewer impeller openings 240, the impeller openings 240 may be of one or more different shapes, and the impeller openings 240 may extend for different lengths of the impeller 200. The shape, number, size, and spacing of the impeller openings 240 depend on numerous factors, such as the overall size of the blast wheel assembly 1, the nature of the media being thrown, and the desired rate of flow, as would be understood by one of skill in the art.

In the embodiment shown in the drawings, the impeller opening side walls 242 form surfaces that extend in an approximately radial direction with respect to the axis of the impeller 200. In other embodiments, however, the side walls 242 may form an angle with respect to the radial direction and may, in some cases, be curved. The top and bottom walls 244, 246 of the impeller openings 240 of the illustrated embodiment define surfaces that are generally perpendicular to the axis of the impeller 200, although this also need not be the case.

As can be seen in FIG. 1, control cage 300, typically formed of cast iron, is positioned concentrically around impeller 200 and, in this embodiment, is approximately cylindrical in shape. Like the impeller, however, control cage 300 may have other shapes, and may, for example, taper internally and/or externally in either direction along its axis. Control cage 300 includes a media opening 305 that receives feed spout 205.

Figure 4:
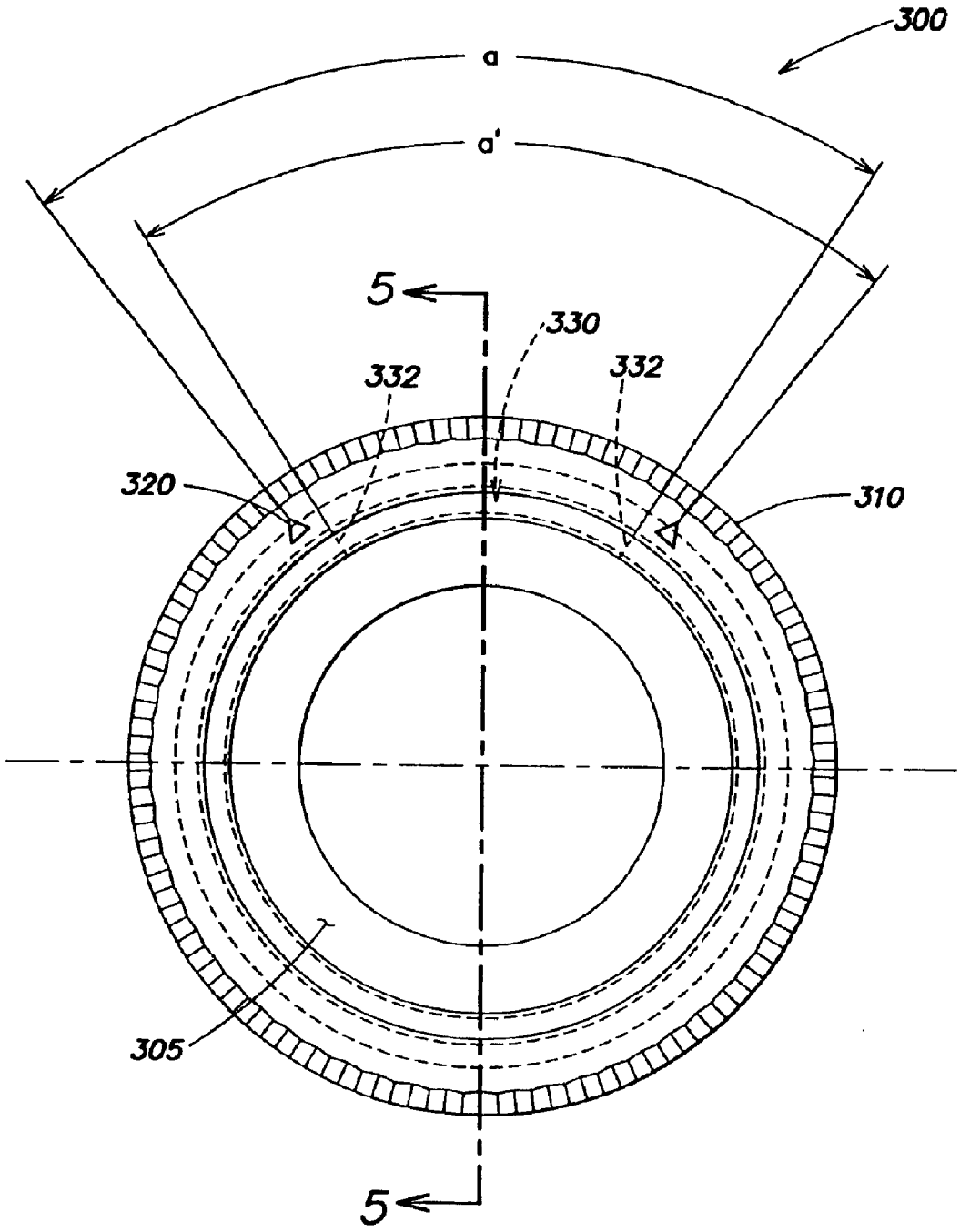
FIG. 4 is an end view of the control cage of FIG. 3.

Control cage 300 of this embodiment also includes an outer flange 310 that mates with adaptor plate 352, which in turn mates with housing 400, fixing the control cage 300 with respect to the housing 400 and preventing it from rotating upon operation of the blast wheel assembly 1. In other embodiments, the control cage 300 may be restrained from movement by attachment to other stationary elements of the blast wheel assembly 1 or its environment, or, in some cases, may be allowed to or made to rotate in one or both directions. As seen in FIG. 4, control cage 300 may have markings 320 or other indicia that allow a user to position the control cage 300 in a certain desired rotational orientation, so as to control the direction of the media being thrown by the blast wheel assembly.

Control cage 300 includes a control cage opening 330 adapted to allow egress of blast media upon operation of the blast wheel assembly 1. In the illustrated embodiment, control cage opening 330 is approximately rectangular in shape when viewed from the side (i.e., in a direction perpendicular to its axis) and is approximately 3/5 the height of control cage 300. The size, shape, and location of the control cage opening 330 may vary depending on the application, however.

The length of the control cage opening 330 is measured in degrees, from the innermost portion of the opening furthest ahead in the direction of rotation to the outermost edge of the trailing portion. In FIG. 4, for example, the control cage opening is denoted by angle $\alpha$ for a wheel assembly that is rotating clockwise, and by angle $\alpha'$ for a wheel assembly that is rotating counterclockwise. While the control cage opening 330 of this embodiment is approximately seventy degrees for a wheel rotating in either direction, in other embodiments, the length of the opening (in either direction) may vary, depending numerous factors such as the overall size of the blast wheel assembly, the nature of the media being thrown, and the desired rate of flow, as would be understood by one of skill in the art. In general, the length of the control cage opening 330 will determine the length of the blast pattern; the longer the opening, the longer the blast pattern, and vice versa. In various other embodiments, the arcs $\alpha$ and/or $\alpha'$ may be, for example, thirty, forty-nine, one hundred, or any other appropriate number of degrees.

The cage opening 330 of the illustrated embodiment includes side walls 332 that are at an angle relative to a line extending in a radial direction from the axis of the control cage 300. In other embodiments, however, one or both of the side walls 332 may form different angles (including 0°) relative to the radial direction and may, in some cases, be curved. The top and bottom walls 344, 346 of the cage opening 330 of the illustrated embodiment define surfaces that are generally perpendicular to the axis of the control cage 300, although this also need not be the case.

Wheel assembly 600, arranged concentrically around control cage 300, consists of a plurality of vanes 630 sandwiched between rear wheel 610 and front wheel 620. The various parts of wheel assembly 600 are typically formed of cast iron, although they may also be made of any other appropriate material and/or method. Wheel assembly 600 is connected to motor 500, in this embodiment by means of key 510 inserted to lock the shaft of motor 500 to rear wheel 610, so that wheel assembly 600 may be rotated by motor 500 during operation of the blast wheel assembly 1. In the illustrated embodiment, one motor 500 drives both the wheel assembly 600 and the impeller 200, although that need not necessarily be the case.

Vanes 630, each of which have a heel end 633 and a tip 636, are constructed and arranged to direct the blast media at the surface being treated. The vanes 630 may be of any suitable size and any suitable shape, including one or more of straight, curved, flared, flat, concave, or convex shapes.

A channel is constructed between the control cage and the impeller to improve the flow of abrasive from the impeller 200 to the hell ends of the vanes 630 and thereby increase the efficiency of the blast wheel assembly 1. The use of a channel allows for increased efficiency while at the same time maintaining the working diameters of the control cage 300 and the impeller 200.

Figure 3:
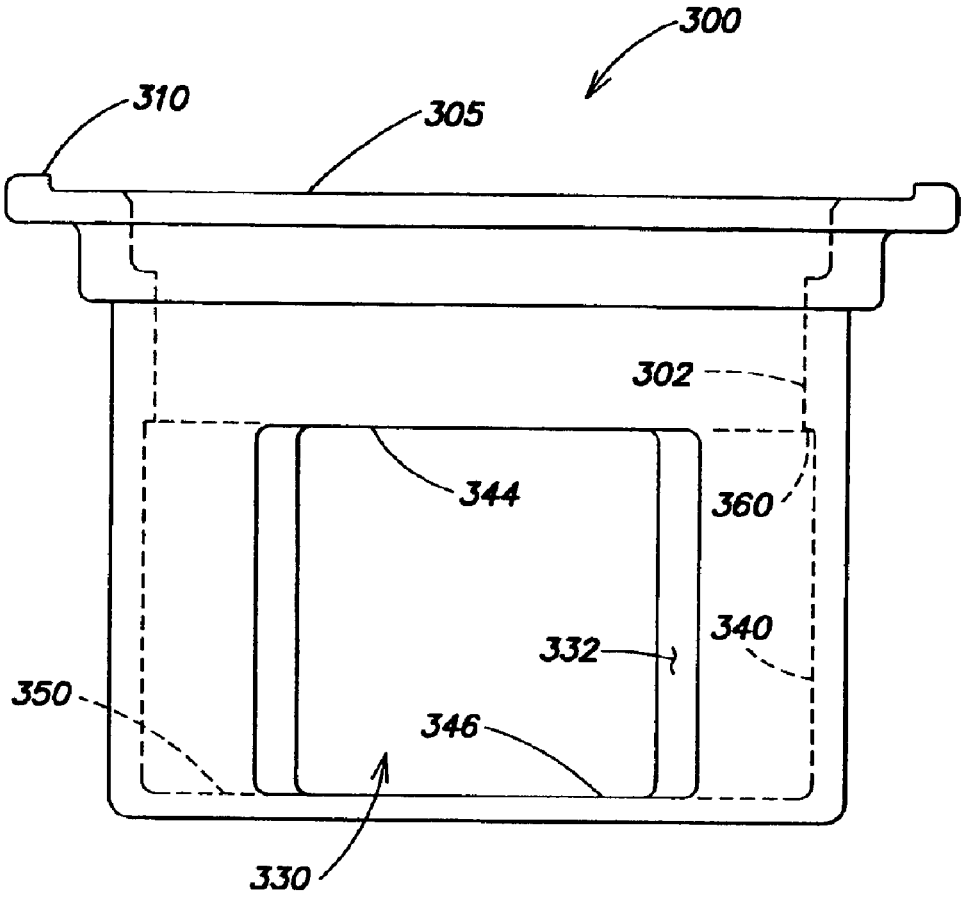
FIG. 3 is a side view of one embodiment of a control cage according to the teachings of the present invention.

In the embodiment shown in FIG. 3, channel 340 is formed in the inner wall 302 of the control cage 300, and is, in essence, a thinning of the wall of the axial portion of control cage 300 that includes the control cage opening 330. This arrangement can be seen most clearly in FIG. 5, which is a side cross-section of the control cage 300 of FIG. 3. The thinned portion of the wall forms channel 340, bounded on one end by the inner end 350 of the control cage and on the other end by the step 360 formed by the transition to the thicker portion of the control cage. In other embodiments, the channel 340 may be bounded on both ends by a step. Although the step 360 of this embodiment is relatively sharp (i.e., at least a portion of the step forms an angle of approximately ninety degrees with the inner wall), more gradual linear or non-linear steps 360 may also be used.

The width of the channel 340 (i.e., the axial dimension) of this embodiment is approximately the same as the height of the control cage opening 330. In other embodiments, however, the channel 340 may be wider or thinner than the control cage opening 330.

Channel 340 increases the diametrical spacing between impeller 200 and the control cage 300 in the area of the control cage opening 330 and has been discovered to improve efficiency of the blast wheel assembly 1. Channel 340 also serves to restrict axial movement of the blast media, limiting the flow of the media along the axial length of control cage 300 and impeller 200, and preventing media from accumulating in the gap between the impeller 200 and the portion of the control cage 300 that does not include the cage opening 340. Reducing the accumulation of blast media in this space reduces friction, thereby also improving efficiency, and reduces wear, lengthening the service life of impeller 200 and/or control cage 300.

The depth of the channel 340 will depend on the specifics of the blast wheel assembly as well as on the nature of blast media being used. Typically, the depth of the channel 340 will be between about 0.0625 and about 0.25 inches, and in at least one embodiment, a depth of about 0.125 inches has been found to be particularly suitable. It should be noted that the channel depth is defined as the radial distance between the impeller 200 and the control cage 300 in addition to the normal clearance between these parts in the absence of a channel. Therefore, in a case in which the distance between impeller 200 and the control cage 300 in the area of the control cage opening 330 would be 0.125 inches in the absence of a channel, and the radial distance between the parts in the area of the channel is 0.25, the depth of the channel is 0.125 inches.

Figure 5:
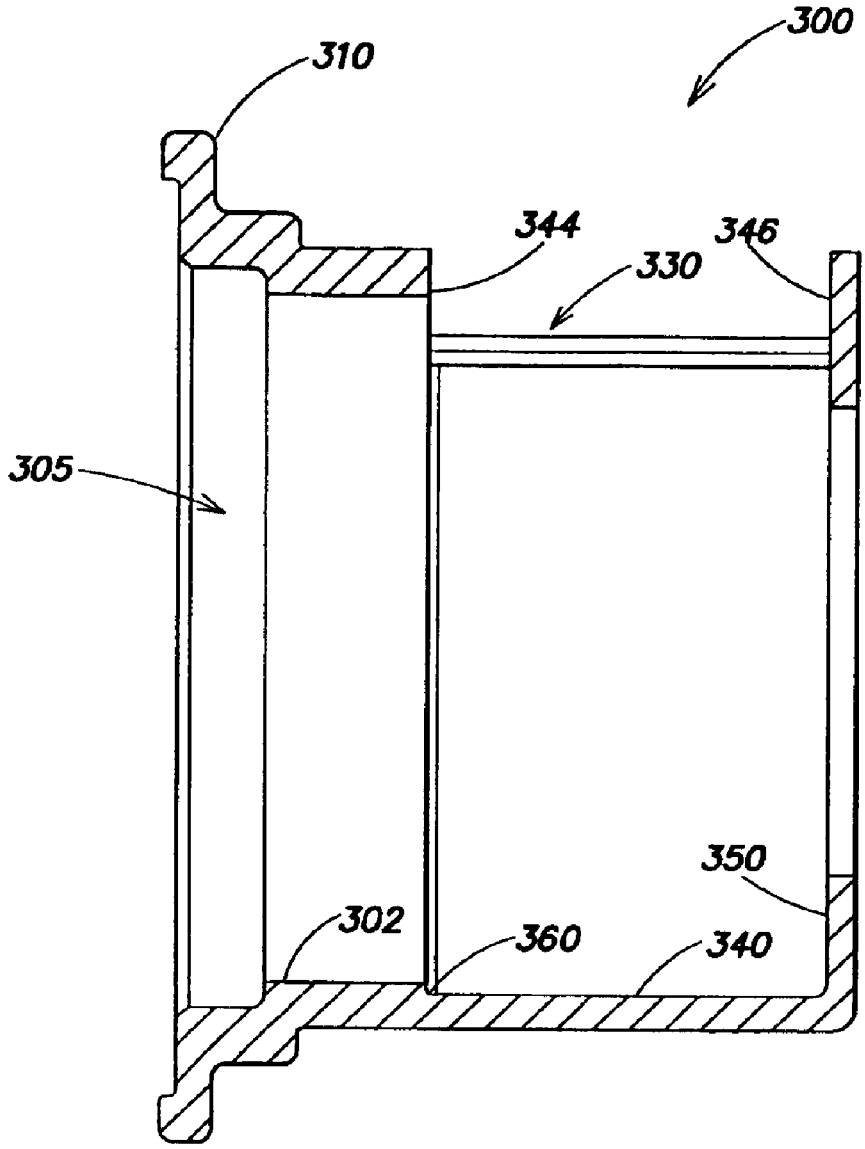
FIG. 5 is a side sectional view taken along line 5—5 in FIG. 4.
Figure 6:
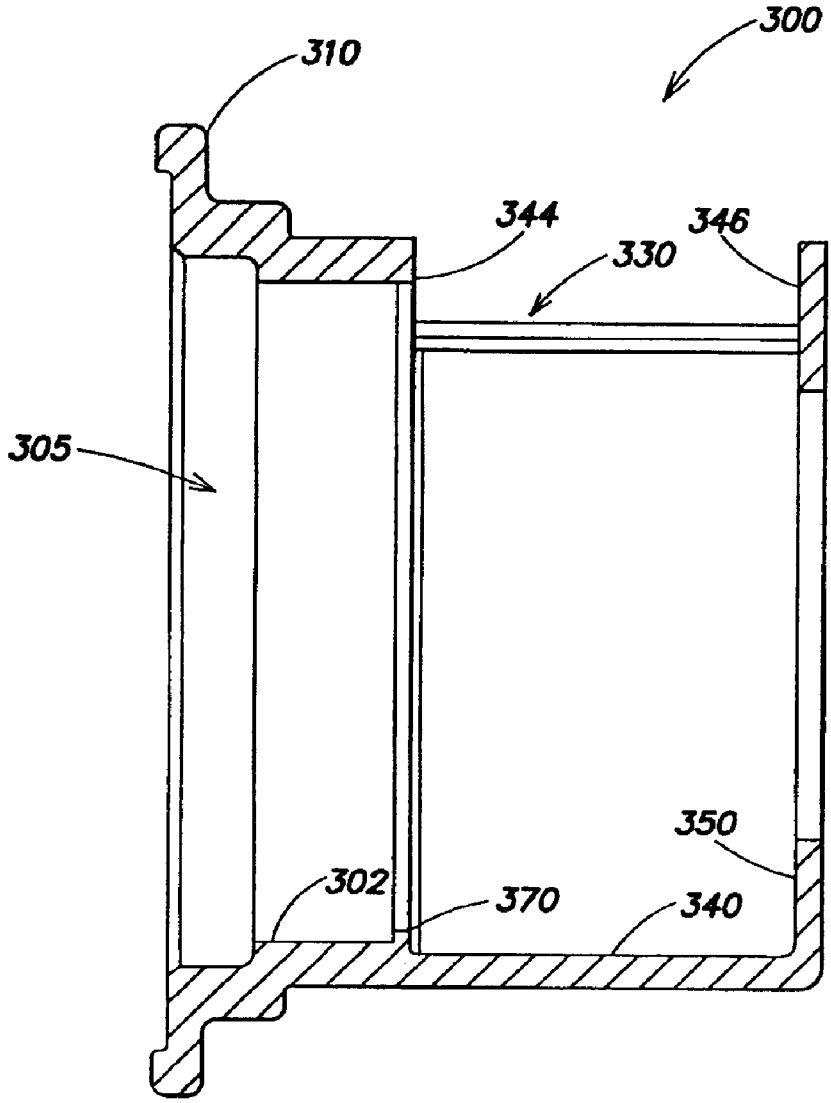
FIG. 6 is a side sectional view of a second embodiment of a control cage according to the teachings of the present invention.

While the channel 340 of the embodiment shown in FIGS. 3–5 is formed by a thinning of the wall of the control cage 300 in the axial portion containing the control cage opening 330, it may be formed in other ways. In another embodiment, for example, the entire wall of the control cage 300 may be thinned and a circumferential ridge 370 may be formed on the inner wall of the control cage 300. Such an arrangement is shown in FIG. 6, in which the channel 340 is formed between the inner end 350 of the control cage 300 and the ridge 370.

Figure 7:
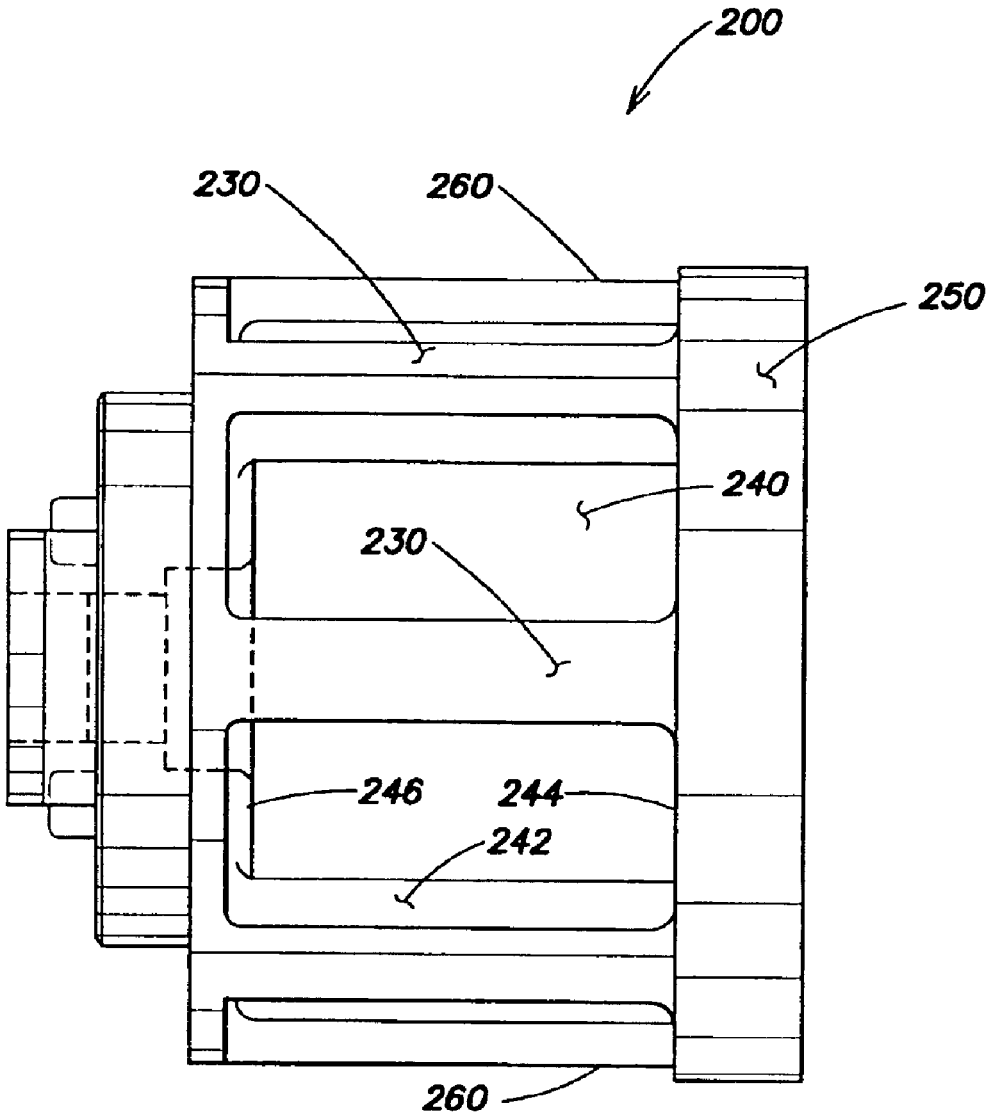
FIG. 7 is a side view of a second embodiment of an impeller according to the teachings of the present invention.

In another embodiment, the channel may be formed on impeller 200, rather than in control cage 300. In such an embodiment, an impeller 200, such as that shown in FIG. 7, includes an impeller channel 260 formed on the outer side of the impeller 200. Such an arrangement could allow the improved efficiency created by the channel to be realized in an application in which the control cage is conventional.

In still another embodiment, the channel may be formed on both impeller 200 and control cage 300. In this type of embodiment, the impeller 200 includes channel 260, and control cage 300 also includes channel 340. In such an arrangement, the channels on the impeller 200 and control cage 300 may be shallower than a single channel located in either part.

Other arrangements of the channel are possible. In some embodiments, for example, the channel may consist of more than one channel which may be of different depths. In another embodiment, the channel (or channels) may have a surface that is concave or convex across its (or their) width (i.e., in a direction parallel to the axis of the control cage) so as to, for example, encourage a particular wear pattern on the channel itself. This type of arrangement may also help distribute the blast media to the blades in a particular fashion, so as to provide an particular blast pattern or for purposes of controlling the wear on the vanes or other parts. Instead of or in addition to having a varying thickness across its width, the channel (or channels) may also have a variable depth lengthwise, i.e., around the circumference of the control cage. In such an arrangement, for example, the channel may have a first depth near one side of the control cage opening that tapers, uniformly or otherwise, to second depth at the other side of the control cage opening.

The operation of the blast wheel assembly can be understood by reference to FIG. 1. The blast media is fed from the feed spout 205 into the rotating impeller 200. By contact with the rotating impeller vanes 230 (as well as with other particles of media already in the impeller 200), the blast media particles are accelerated, giving rise to a centrifugal force that moves the particles in radial direction, away from the axis of the impeller 200. The particles, now moving in a generally circular direction as well as outwards, move through the impeller openings 240 into the space between the impeller 200 and the control cage 300, still being carried by the movement of the impeller vanes 230 and the other particles.

When the particles that have passed though the impeller openings 240 into the space between the impeller 200 and the control cage 300 reach the control cage opening 330, the rotational and centrifugal forces move the particles through the control cage opening 330 and onto the heel ends 633 of the vanes 630. The control cage 300 functions to meter a consistent and appropriate amount of blast media onto the vanes 630. As the vanes 630 rotate, the particles are moved along their lengths and accelerate until they reach the tips 636, at which point they are thrown from the ends of the vanes 630.

It has been determined that, by adding a channel to the control cage and/or impeller, the efficiency of a given wheel can be markedly increased. The channel allows additional particles to be moved through the impeller and control cage openings, while at the same time maintaining a sufficiently small clearance that flow velocity and volume are not detrimentally affected.

A series of tests were performed to assess the abrasive flow improvement resulting from the channel in the control cage. A Wheelabrator® design EZEFIT™ wheel was used operating at a fixed horsepower and rpm. The maximum flow of abrasive was established in pounds per minute at full load amperage for the motor. The work amps (full load—no load) necessary to maintain that flow provided an operating factor baseline in pounds per minute of flow per work amp. Tests were run with incremental changes in channel clearance dimensions to confirm the optimum clearance for improved abrasive flow. Improvement measurements were a function of a reduction in motor amperage required to flow the fixed amount of abrasive. For steel shot and grit abrasives, a channel depth of 0.125 inches produced the most effective flow rate improvement. One particular steel shot test resulted in a calculated improvement in flow of 12.6% over the same wheel using a control cage without the channel. Further steel abrasive testing determined that increasing the channel depth beyond 0.125 inches resulted in a loss of efficiency, i.e., an increase in amperage for the fixed amount of abrasive flow.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A control cage for an abrasive blasting wheel, comprising:

a housing forming an interior chamber;

a blast media outlet positioned in the housing, and a channel formed in an inner side of the housing, wherein at least a portion of the channel is in axial alignment with the blast media outlet.

2. The control cage of claim 1, wherein:

the channel further comprises a step on the inner side of the housing.

3. The control cage of claim 1, wherein:

the channel further comprises a ridge on the inner side of the housing.

4. The control cage of claim 1, wherein:

the housing has a first thickness in a portion that does not include the channel and a second thickness, less than the first thickness, in a portion that includes the channel.

5. The control cage of claim 1, wherein the channel is between about 0.0625 and about 0.25 inches deep.

6. The control cage of claim 5, wherein the channel is about 0.125 inches deep.

7. The control cage of claim 1, wherein the channel has a depth that varies across its width.

8. The control cage of claim 1, wherein the channel has a depth that varies along its length.

9. The control cage of claim 1, further comprising indicia to denote the position of the blast media outlet.

10. A distribution device for an abrasive blasting wheel, comprising:

an impeller having a media inlet at one end adapted to receive blast media and a plurality of impeller media outlets constructed and arranged to allow egress of the blast media upon rotation of the impeller;

a control cage surrounding the impeller and having a cage media outlet adapted for passage of the blast media; and a channel formed between the impeller and the control cage, wherein at least a portion of the channel is in axial alignment with the case media outlet.

11. The distribution device of claim 10, wherein:

the channel is formed on an inner side of the control cage.

12. The distribution device of claim 10, wherein:

the channel is formed on an outer side of the impeller.

13. The distribution device of claim 10, wherein:

the channel is formed on both an inner side of the control cage and an outer side of the impeller.

14. The distribution device of claim 10, wherein:

a distance between the impeller and a portion of the control cage that includes the cage media outlet is greater than a distance between the impeller and a portion of the control cage that does not include the cage media outlet.

15. The distribution device of claim 10, wherein the channel is between about 0.0625 and about 0.25 inches deep.

16. The distribution device of claim 15, wherein the channel is about 0.125 inches deep.

17. The distribution device of claim 10, wherein the channel has a depth that varies across its width.

18. The distribution device of claim 10, wherein the channel has a depth that varies along its length.

19. An abrasive blast wheel assembly, comprising:

a wheel having a face and an axis generally perpendicular to the face;

a plurality of vanes extending from the face of the wheel, each vane having a heel end towards the axis of the wheel and a discharge end opposite the heel end;

an impeller positioned about the axis of the wheel, the impeller having a media inlet at one end adapted to receive blast media and a plurality of impeller media outlets constructed and arranged to allow egress of blast media upon rotation of the impeller;

a control cage surrounding the impeller and having a cage media outlet adapted for passage of blast media to the heel ends of the vanes; and a channel formed between the impeller and the control cage, wherein at least a portion of the channel is in axial alignment with the cane media outlet.

20. The abrasive blast wheel assembly of claim 19, wherein: the channel is formed on an inner side of the control cage.

21. The abrasive blast wheel assembly of claim 19, wherein: the channel is formed on an outer side of the impeller.

22. The abrasive blast wheel assembly of claim 19, wherein:

the channel is formed on both an inner side of the control cage and an outer side of the impeller.

23. The abrasive blast wheel assembly of claim 19, wherein the channel is between about 0.0625 and about 0.25 inches deep.

24. The abrasive blast wheel assembly of claim 23, wherein the channel is about 0.125 inches deep.

25. The abrasive blast wheel assembly of claim 19, wherein the channel has a depth that varies across its width.

26. The abrasive blast wheel assembly of claim 19, wherein the channel has a depth that varies along its length.

27. The abrasive blast wheel assembly of claim 19, wherein:

a distance between the impeller and a portion of the control cage that includes the cage media outlet is greater than a distance between the impeller and a portion of the control cage that does not include the cage media outlet.

* * * * *